US007537308B2

(12) United States Patent
Yamane

(10) Patent No.: US 7,537,308 B2
(45) Date of Patent: May 26, 2009

(54) DATA PROCESSING METHOD AND INK JET PRINTING APPARATUS

(75) Inventor: Toru Yamane, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 11/610,129

(22) Filed: Dec. 13, 2006

(65) Prior Publication Data

US 2007/0139452 A1 Jun. 21, 2007

(30) Foreign Application Priority Data

Dec. 15, 2005 (JP) ..... 2005-362418

(51) Int. Cl.
*B41J 2/165* (2006.01)
*B41J 29/38* (2006.01)

(52) U.S. Cl. ..... 347/35; 347/9

(58) Field of Classification Search ..... 347/35
See application file for complete search history.

(56) References Cited

U.S. PATENT DOCUMENTS 5,659,342 A * 8/1997 Lund et al. ..... 347/35
5,903,288 A * 5/1999 Yamaguchi ..... 347/35
2006/0055715 A1* 3/2006 Nakahara et al. ..... 347/5

FOREIGN PATENT DOCUMENTS

JP 54-051837 4/1979
JP 6-040042 2/1994

* cited by examiner

*Primary Examiner*—Luu Matthew
*Assistant Examiner*—Shelby Fidler
(74) *Attorney, Agent, or Firm*—Fitzpatrick, Cella, Harper & Scinto

(57) ABSTRACT

A method is provided which is intended to reduce a visibility of ink dots ejected onto a print medium during a preliminary ejection operation to produce a satisfactory printed image. Preliminary ejection data is compared with image data. When the preliminary ejection is necessarily performed on a pixel that has no image data, image data of a pixel close to the pixel being processed is searched. When image data exists, the image data is moved to a pixel that has preliminary ejection data. The preliminary ejection data is added to the image data one scan at a time to perform printing.

7 Claims, 14 Drawing Sheets

DATA PROCESSING METHOD AND INK JET PRINTING APPARATUS

BACKGROUND OF THE INVENTION

1. Field of the Invention

The present invention relates to a data processing method and an ink jet printing apparatus and more particularly to a data processing method and a printing apparatus that perform a preliminary ejection on a print medium.

2. Description of the Related Art

An ink jet printing apparatus forms an image by ejecting ink from ink nozzles in a print head onto a print medium. Such type of a print head includes one which applies heat to ink by a heater to create a bubble in ink and eject a drop of ink by the pressure of the inflating bubble (Japanese Patent Application Laid Open No. S54-51837) and one that uses a piezoelectric element to eject ink by its mechanical pressure.

In a state in which the ink ejection nozzles are not ejecting ink, water in the ink near an opening of each nozzle readily evaporates, making ink more viscous. Such viscosity increased ink causes ejection failures, such as an ink dot ejection direction being bent or an ink ejection volume becoming too small. Especially, as the nozzle opening diameter decreases, the ejection failure becomes more likely to occur. The ejection failure also occurs due to other causes, such as fine paper powder and water mist adhering to the nozzle opening.

To deal with this problem, it is conventional practice for the ink jet printing apparatus to execute a so-called preliminary ejection, which is not involved in the image forming, immediately before a printing operation or at predetermined intervals during the printing operation. The preliminary ejection discharges viscous ink to forestall possible ejection failures. In a system in which an image is printed on a print medium by scanning a carriage mounting the print head, this preliminary ejection is performed by the carriage moving to a predetermined location, such as a waste ink absorbing member, outside the print medium. Thus, moving the carriage for the preliminary ejection makes the time required for the overall printing operation longer, lowering throughput.

As another preliminary ejection operation, a preliminary ejection operation has been known to eject ink onto the print medium and not to be intended for image forming (hereinafter referred to also as "on-paper preliminary ejection") (Japanese Patent Application Laid Open No. H06-40042). Particularly, this on-paper preliminary ejection can also be used to ensure that when a nozzle that has not performed the ink ejection for some duration because of print data makes its first ejection after the rest, an ejection characteristic of the first ejection (referred to also as a "first ejection characteristic") is satisfactory. The on-paper preliminary ejection is normally performed by a single (one drop) ejection and is performed at intervals corresponding to the degree of ink viscosity.

However, in the conventional on-paper preliminary ejection, ejection locations on an image being formed and the number of ejections are preset and thus the preliminary ejection is executed irrespective the position of the image. Consequently, if dots forming an image (image dots) and dots for the one on-paper preliminary ejection (preliminary ejection dots) are printed in vicinity to each other, both dots may be mixed. Because of mixing these dots, a density of the image may increase, degrading a quality of the printed image.

SUMMARY OF THE INVENTION

The present invention has been accomplished to solve these problems, and the object of the present invention is to provide a data processing method and an ink jet printing apparatus that are capable of reducing the change in density of the image caused by printing the image dots, and the preliminary ejection dots, in vicinity pixels to each other.

To achieve the above objective, the present invention can provide a data processing apparatus for processing data for a preliminary ejection in which ink is ejected from a print head onto a print medium, the data processing apparatus comprising a determining unit for determining whether an image data exists or not in a vicinity pixel of a pixel at which the image data dots do not exist and for which the preliminary ejection is to be performed; and a data processing unit for processing data so that ink is not ejected to the vicinity pixel and ink is ejected to the pixel for which the preliminary ejection is to be performed, if the determining unit determines that the image data exists in the vicinity pixel, and processing data so that ink is ejected to the pixel for which the preliminary ejection is to be performed, if the determining unit determines that the image data does not exist in the vicinity pixel.

With the above configuration, if an image data exists in a vicinity pixel to a pixel for which an image data does not exist, and a preliminary ejection is to be excused, an ink ejection is not performed to the vicinity pixel. While, to the pixel for which the preliminary ejection is to be executed, the ink ejection is performed independently of the fact whether image data exist or not in the vicinity pixel. As a result, the overlapping of the preliminary ejection dot and the image dot of vicinity can be reduced which executing necessary preliminary ejection, thus changing density which is caused by mixing these dots can be reduced.

Further features of the present invention will become apparent from the following description of exemplary embodiments (with reference to the attached drawings).

DESCRIPTION OF THE EMBODIMENTS

In the present invention, if image data exists in a vicinity pixel of a pixel for which image data does not exist, and a preliminary ejection is to be excused, an ink ejection is not performed to the vicinity pixel. In addition, for the pixel for which the preliminary ejection is to be executed, the ink ejection is performed independently of the fact of whether image data exists or not in the vicinity pixel. As a result, the overlapping of the preliminary ejection dot and the image dot of vicinity can be reduced, thus changing density which is caused by mixing these dots can be reduced. Now, embodiments of this invention will be described in detail by referring to the accompanying drawings.

Embodiment 1

Figure 1:
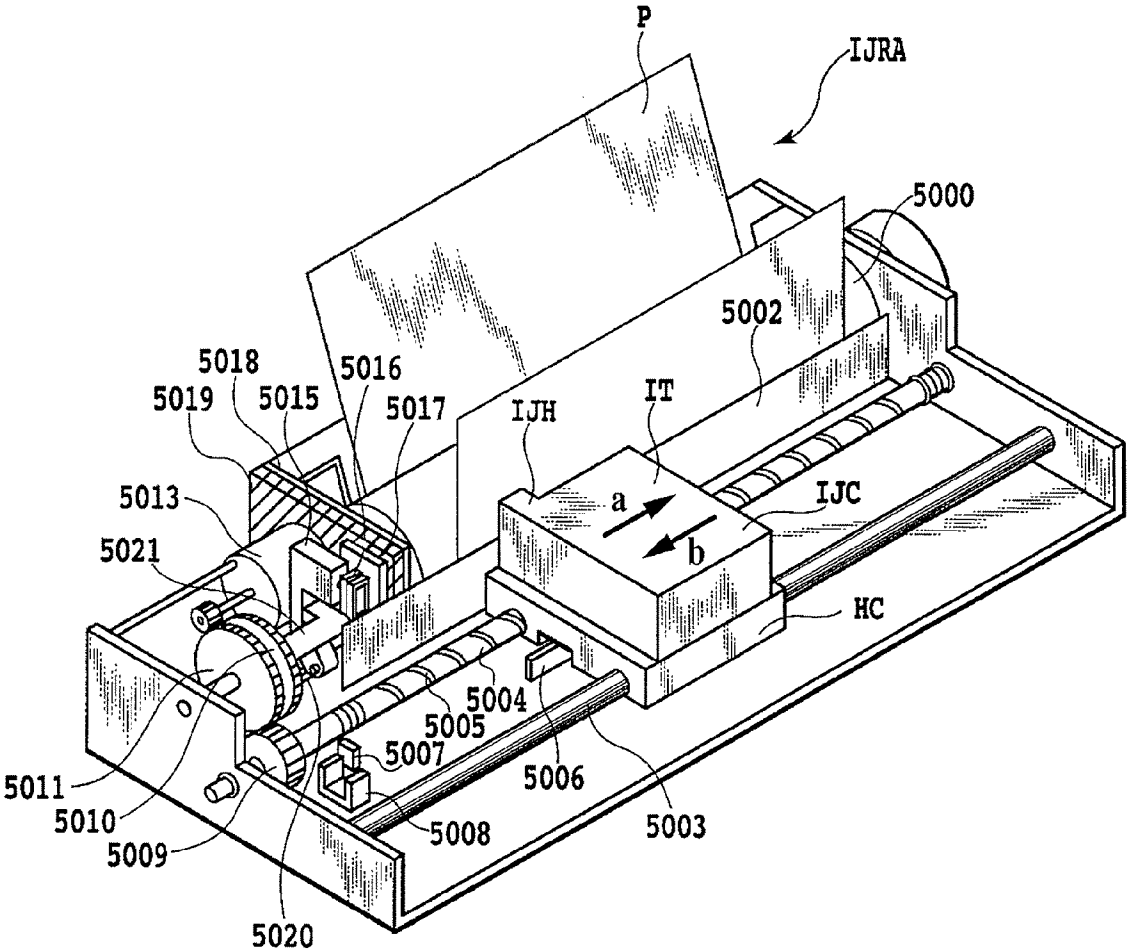
FIG. 1 is a perspective view of an ink jet printing apparatus as one embodiment of this invention.

FIG. 1 is a perspective view showing an ink jet printer IJRA as one embodiment of the ink jet printing apparatus according to this invention. In the figure, a carriage HC mounts an ink tank IT accommodating ink and an integrated ink jet cartridge IJC incorporating a print head that ejects ink toward a print medium P such as print paper.

The print paper P is held between a paper retainer 5002 arranged opposite the ink jet cartridge IJC and a rotatably mounted platen 5000. The carriage HC engages a spiral groove 5004 of a lead screw 5005 so that a rotating force of a drive motor 5013 is transmitted to the carriage HC through drive force transmission gears 5009-5011. The carriage HC has a pin (not shown) and reciprocally moves, supported on a guide rail 5003, in directions of arrow a and b.

At one end in its moving direction, the carriage HC has a lever 5006, which is detected by two photocouplers 5007, 5008 installed in the printing apparatus to determine a home position, at which time the rotation direction of the drive motor 5013 is switched.

The carriage HC stops at the home position at the start of a printing operation or during the printing operation, as required. At this home position, a cap member 5022 to cap an ejection face (nozzle face) of the ink jet print head formed with nozzles is supported by a support member 5016. Then, the cap member 5022 executes a suction-based recovery operation on the print head by a sucker 5015 that sucks out ink from the cap through an opening 5023 in the cap.

A cleaning blade 5017 can be moved back and forth by a member 5019. These are supported on a body support member 5018.

A lever 5021 is a lever to start the suction-based recovery operation and moves with a cam 5020 that engages the carriage HC. The lever movement is controlled by a transmission mechanism that switches a clutch by the drive force of the drive motor.

Figure 2:
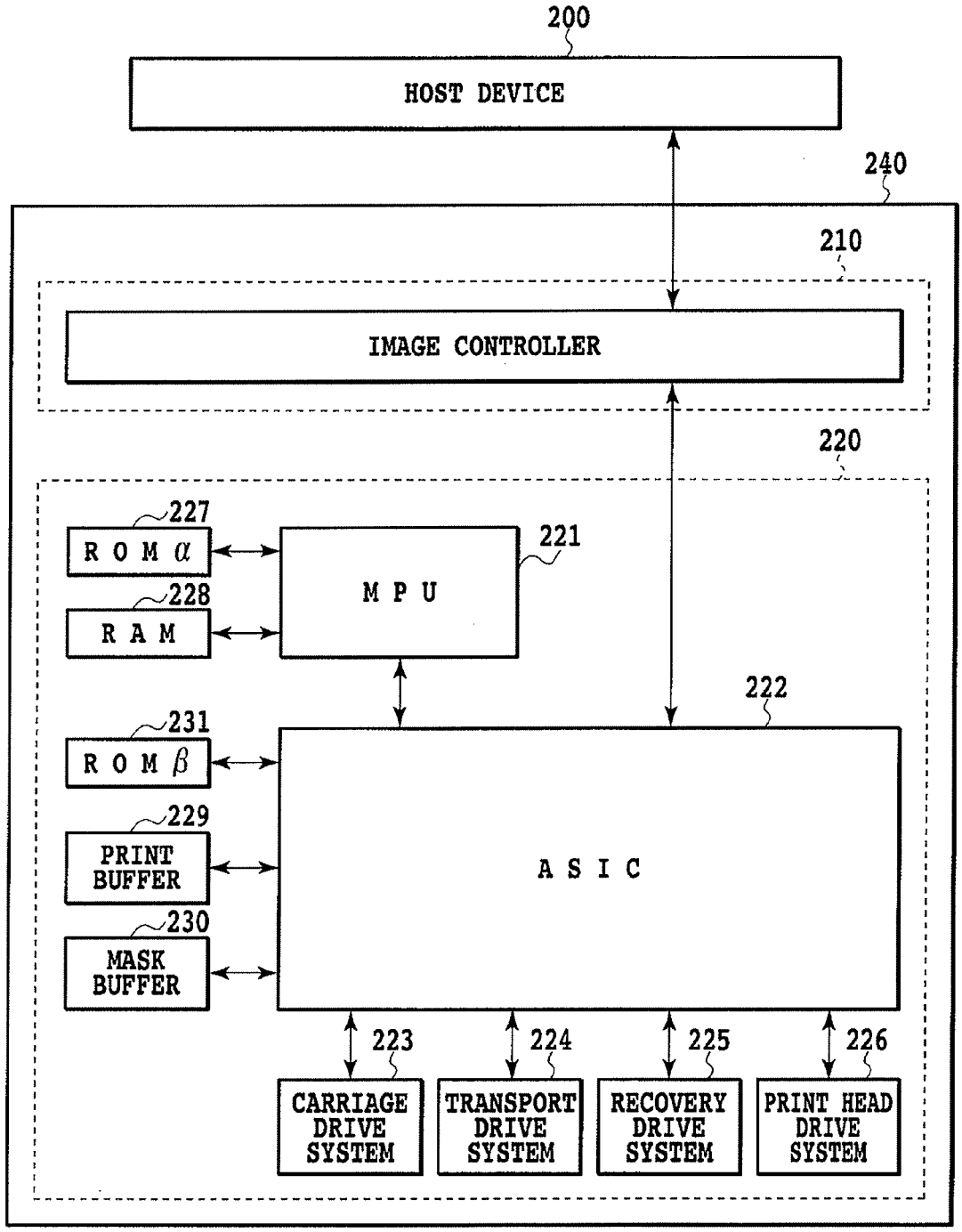
FIG. 2 is a block diagram showing a control configuration to execute image processing according to embodiment 1 of this invention.

FIG. 2 is a block diagram showing a control configuration for data processing in this embodiment.

Denoted 200 is a host device, 240 a printing apparatus body, 210 an image controller, and 220 a print engine. The image controller 210 stores print data sent from the host into a reception buffer and, in various image processing described later, is used as a controller that has a memory function to store the print data. In the printing apparatus body 240, a carriage drive system 223, a transport drive system 224, a recovery drive system 225 and a print head drive system 226 are controlled by an MPU 221 according to programs stored in a ROMα 227. A RAM 228 is used as a work area for the MPU 221 or as an area to temporarily save data. Individual controls are performed via an ASIC 222. Also through the ASIC 222 the read/write operation on a print buffer 229 and a mask buffer 230 can be performed.

The print buffer 229 is a buffer memory to temporarily save print data that is transformed into a format transferable to the print head and, in this embodiment, stores print data of one scan. The mask buffer 230 temporarily stores a mask pattern for multipass printing corresponding to the print mode. In performing the multipass printing, data that the print head actually prints in each print scan is determined from the print data stored in the print buffer 229 and the mask pattern stored in the mask buffer 230. In a 1-pass printing, the mask pattern is not required and thus the above processing is not performed.

A ROMβ 231 stores beforehand a preliminary ejection pattern attached to the binarized print data. The MPU 221 reads the pattern data from the ROMβ through the ASIC 222 and adds the desired preliminary ejection pattern.

More specifically, the print operation is started upon input of the image data from the outside host device 200 connected to the printing apparatus body 240 to the reception buffer of the image controller 210. The image data includes, in addition to the print data, other information necessary for printing such as print quality and margin. The print engine 220 analyzes the received image data and starts control according to various information. At this time, information such as print data, print quality, media and margin information are processed by the MPU 221 through the ASIC 222 and held in the RAM 228. This information is then referenced as situation demands and used for sectionalizing the processing. Further, the print mode is determined by the print quality and media information and then a mask pattern corresponding to the print mode is read from the ROMα 227 and written into the mask buffer 230.

The print data is sent from the host device 200 and, when received by the image controller 210, is multi-valued data having density information.

When the print data of one scan is accumulated in the print buffer 229, the MPU 221 drives the transport drive system 224 through the ASIC 222 to execute a print medium feeding operation and also drives the carriage drive system 223 to execute a recovery operation. When the carriage reaches the predetermined print start position, the print data held in the print buffer 229 is sequentially read out in accordance with the ejection timing and transferred to the print head through the print head drive system 226.

Figure 3:
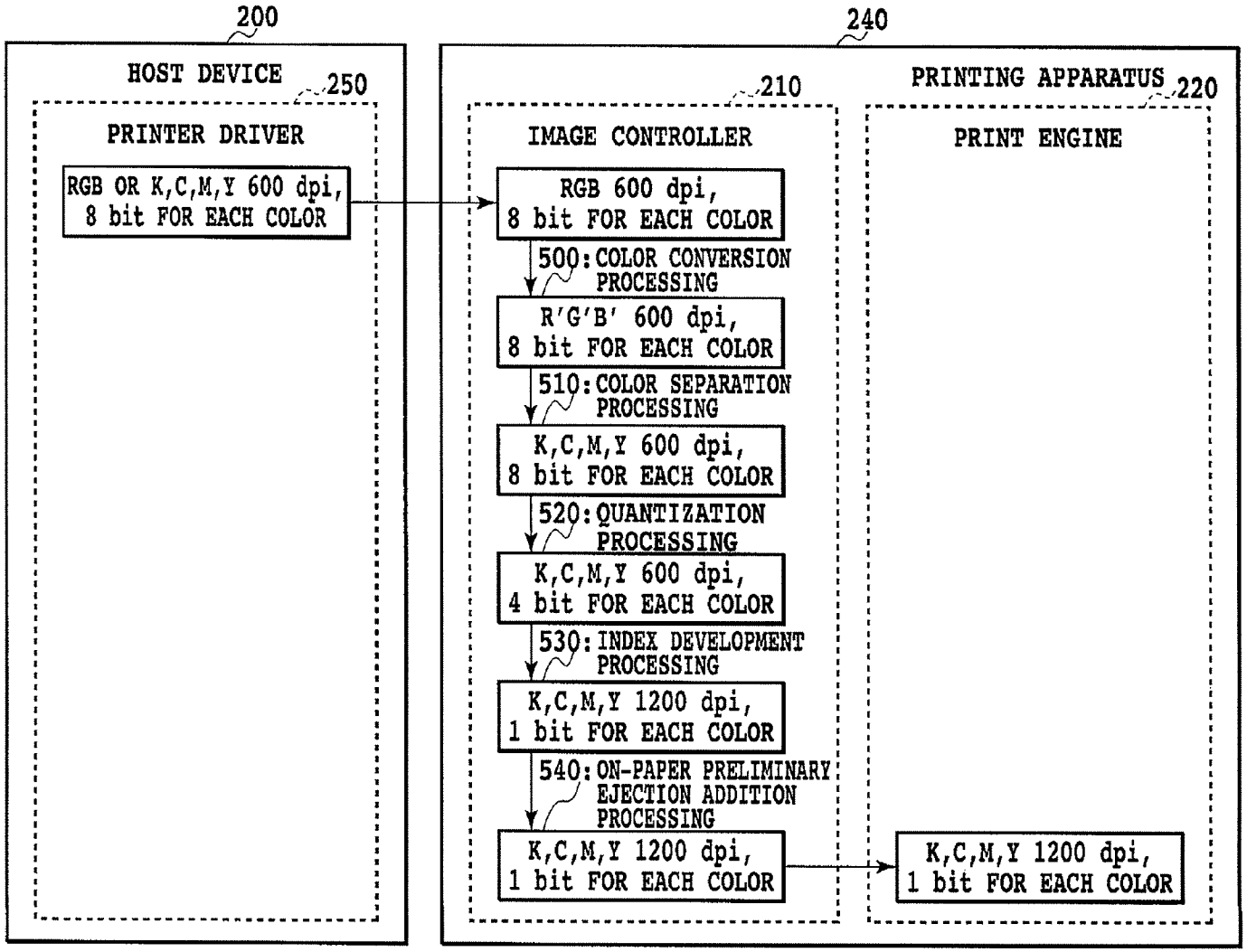
FIG. 3 is a block diagram showing a flow of data in the printing apparatus according to embodiment 1 of this invention.

FIG. 3 is a block diagram showing a flow of data. Under the control of the MPU 221, an image controller 210 converts 8 bits data of R,G,B into 8 bits data of R'G'B' inherent in the printing apparatus (a color conversion processing 500). Then, the controller converts 8 bits data of R'G'B' into 8 bits data of C,M,Y,K (a color separation processing 510). Subsequently, the controller quantizes 8 bit data of C,M,Y,K to be 4 bit data (a quantization processing 520). Next, the controller converts 4 bits data of C,M,Y,K into 1 bit data (image data of binary)

of C,M,Y,K (an index development processing 530). Further, to this binarized image data the MPU 221 adds on-paper preliminary ejection data described later to produce data in a format transferable to the print head. At this stage, the data obtained is written into the print buffer 229.

Figure 4:
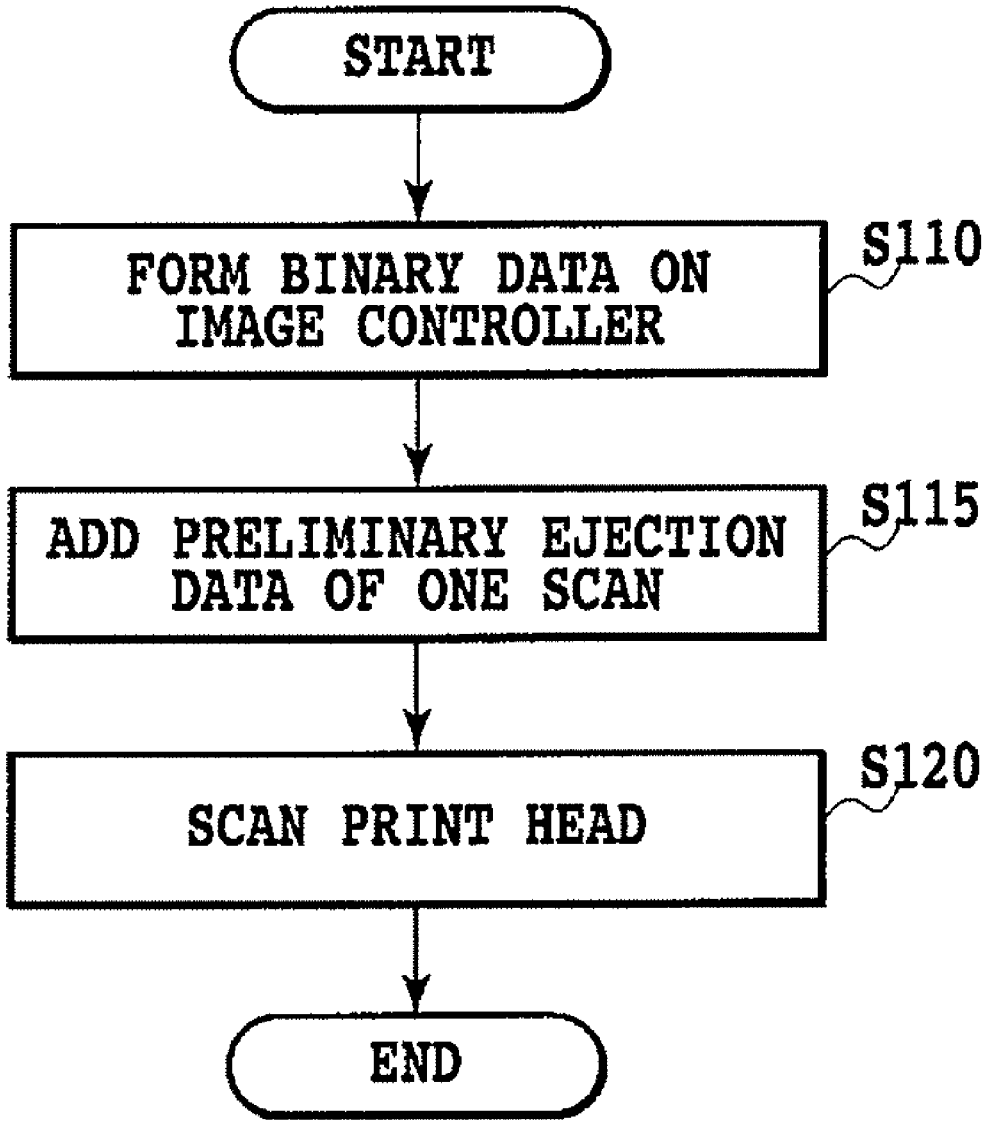
FIG. 4 is a flow chart showing a sequence of one scan performed by a print head according to embodiment 1 of this invention.

FIG. 4 is a flow chart showing a sequence of steps performed during the one scan of the print head.

From R, G, B data the image controller 210 produces C, M, Y, K binarized image data (hereinafter referred to also as "image data") (S110). Then, to the binarized image data the preliminary ejection data of one scan is added (S115). The data attached with the preliminary ejection data is transferred to the print head, which is then scanned for printing (S120).

Next, the method of adding the preliminary ejection data according to the first embodiment of this invention will be explained.

Since an A4-size print medium is printed at an image density of 1,200 dpi, about 10,000×16,000 pixels are actually printed in each A4-size page. For the purpose of simplicity in the drawing and explanation, we will take up an example pixel array of 16×16.

Figure 5A:
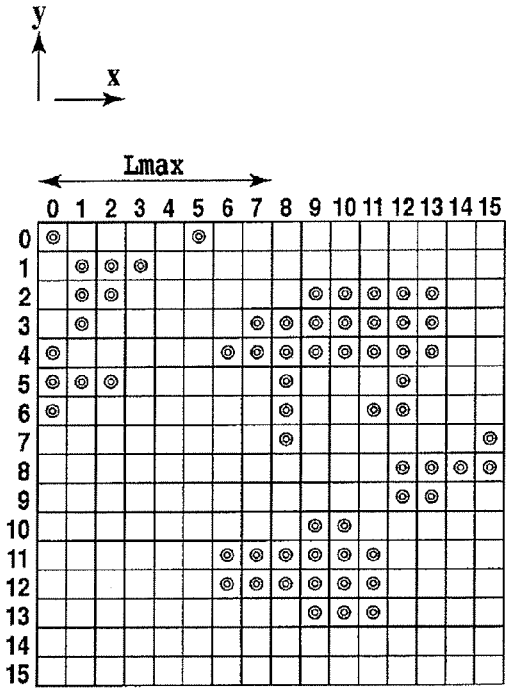
FIGS. 5A, 5B, 5C and 5D show data positions in pixels.
Figure 5B:
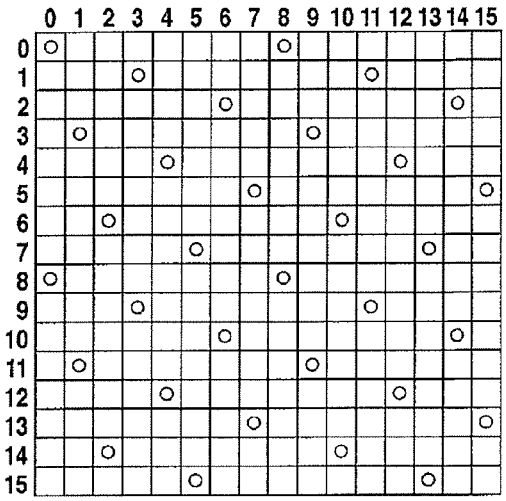
Figure 5C:
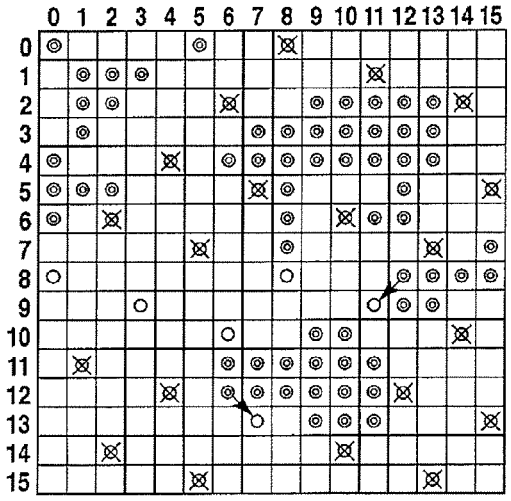
Figure 5D:
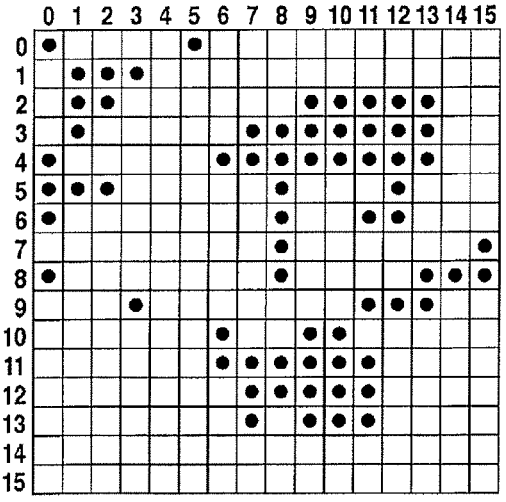

FIGS. 5A to 5D represent a process of adding preliminary ejection data to the image data of 16×16 pixel array. The process shown in the figures concerns adding the preliminary ejection data of one of the C, M, Y and K print heads. FIG. 5A shows binarized image data, in which "◉" indicates that the image data is "1", meaning that a dot will be formed at that pixel to construct image. FIG. 5B shows a pattern of preliminary ejection data (predetermined pixel for which the preliminary ejection will be performed) stored in advance in the ROMβ 231. Here the marking "○" indicates that the preliminary ejection data is "1", meaning that a dot will be formed at that pixel by the preliminary ejection. FIG. 5C explains placement of logical addition of data of FIG. 5A and FIG. 5B, and data processing of FIG. 6. According to such a logical addition, even if the image data and the preliminary ejection data exist in the same pixel, only one dot is printed in that pixel, thus the dot of image and dot of preliminary are not overlapped in the same pixel. That is, taking the logical addition of the image data and the preliminary ejection data means to eliminate either the image data or the preliminary ejection data. FIG. 5D shows ejection data that causes the print head to actually eject ink after the data processing of FIG. 6 has been executed.

Figure 6:
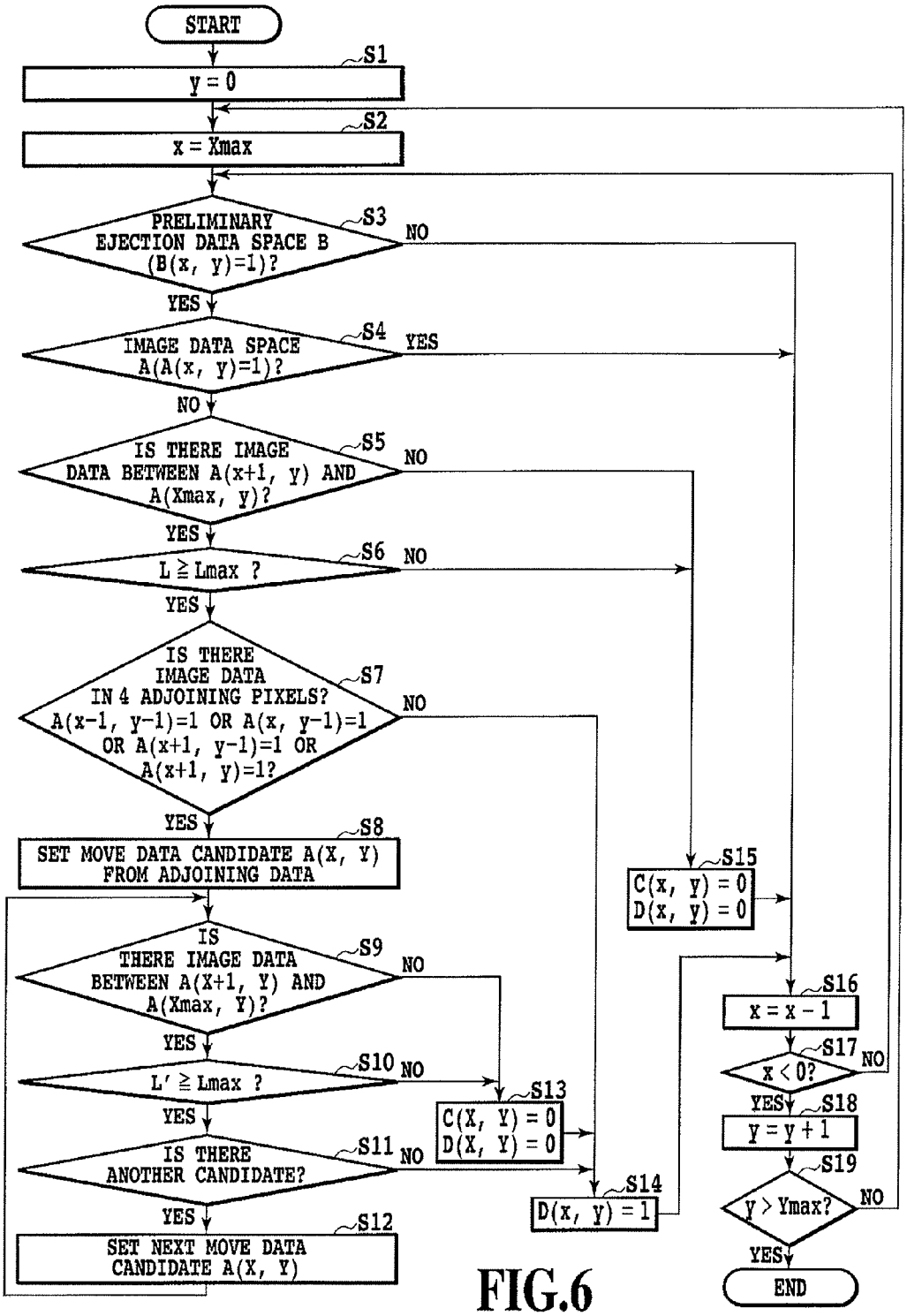
FIG. 6 is a flow chart showing a process of adding preliminary ejection data according to embodiment 1 of this invention.

FIG. 6 is a flow chart showing processing of adding preliminary ejection data according to this embodiment.

In the following explanation, it is assumed that a main scan direction of the print head is x and a sub scan direction (nozzle array direction in the print head) is y and that the image data of one scan shown in FIG. 5, when viewed in the x direction, ranges from 0 to Xmax (in FIG. 5, from 0 to 15) and, when viewed in the y direction, ranges from 0 to Ymax (in FIG. 5, from 0 to 1). In the image data shown in FIG. 5A, image data at a pixel location (x, y) is denoted A(x,y), and in the preliminary ejection pattern shown in FIG. 5B, predetermined pixel for which the preliminary ejection will be performed, preliminary ejection data at a pixel location (x, y) is denoted B(x, y). Similarly, data of a logical addition shown in FIG. 5C is denoted C(x, y) and ejection data shown in FIG. 5D is denoted D(x, y). The processing shown in FIG. 6 involves checking the addition of the preliminary ejection data to each pixel location beginning with x=Xmax toward x=0 in the x direction one pixel at a time and then executing this x-row direction processing from y=0 toward y=Ymax sequentially one x row at a time until the addition of the preliminary ejection data is determined for the entire one-scan data.

First, at step S1 and step S2, y=0 and x=Xmax are set. That is, first object pixel of the image to be processed is determined.

Next, at step S3, a check is made as to whether at the object pixel there is preliminary ejection data (marking "○"="1") of the pattern of FIG. 5B. That is, if B(x, y)=0, the preliminary ejection data does not exist in that pixel. So, there is no need to execute the preliminary ejection and the processing moves to step S16 where the above processing is executed for the next pixel position.

However, at step S3, if B(x, y)=1, the processing proceeds to step S4. In step S4, a check is made to see if there is image data at the object pixel. If A(x, y)=1, that is, the image data exists (marking "◉"="1"), the processing moves to step S16 where it processes the next pixel position. In addition, at step S4, determining of A(x, y)=1 means that image data and the preliminary ejection data exist at the object pixel. Even in this case, the dot forming an image (the image dot) and the dot formed by a preliminary ejection (the preliminary ejection dot) are not overlapped. The reason is that the logical addition of the image data and the preliminary ejection data is taken. This embodiment can reduce increasing of the density caused by overlapping both dots, because the image dot and the preliminary ejection dot do not overlap in same pixel.

For example, at the pixel position of (x, y)=(3, 1) in FIG. 5, there are image data and preliminary ejection data, i.e., A(3, 1)=1 and B(3, 1)=1. In that case, because there is image data at a pixel position where the preliminary ejection is necessary, the image data is left as is and C(3, 1)=1 is set. As a result, the ejection data will be D(3, 1)=1.

In step S4, if A(x, y)=0, the processing moves to step S5. Here, it is checked whether there is image data beyond next object pixel (x+1) toward right up to Xmax. That is, if there is no image data beyond the object pixel in the main scan direction of the print head, the printing is not performed any more in the current scan and there is no need to perform the on-paper preliminary ejection. That is, without the preliminary ejection being performed beyond the object pixel position, the limit distance (time) at which the first ejection characteristic described later deteriorates may be exceeded and the first ejection characteristic may actually degrade. However, the degradation of the first ejection characteristic is not as bad as ejection failures and is relatively slight. Considering the above, this embodiment does not perform a special measure against the characteristic deterioration. This characteristic deterioration is restored by the ejection for printing or on-paper preliminary ejection during the next scan (although these ejections themselves may have a degraded first ejection characteristic). It should be noted that normal preliminary ejections to deal with more severe ejection failures are of course executed separately. For example, the normal preliminary ejection may be performed by moving the print head to outside of print medium location in each predetermined scan. This method is effective where printing is done on particularly large sized paper.

If step S5 decides that there is no image data between A(x+1, y) and A(Xmax, y), preliminary ejection data B(x, y)=1 is erased and C(x, y)=0 is set (in FIG. 5C, marking "○" is replaced with "X"). As a result, the final ejection data will be D(x, y)=0 (S15).

For example, in FIG. 5 at (x, y)=(8, 0) and (x, y)=(10, 14) are B(x, y)=1, but between (8+1, 0) and (15, 0) and between (10+1, 14) and (15, 14) there is no image data A(x, y)=0. In that case, step S15 sets C(x, y)=0 to eliminate preliminary ejection data at the object pixel and therefore the ejection data will be D(x, y)=0. Step S5, as described above, is the step which checks the content of a pixel based on the image data in order to eliminate the pixel for which the preliminary ejection is not executed out of the pixels for which the preliminary ejection is to be executed.

If step S5 decides that image data exists, it moves to step S6. In step S6, it is checked whether or not a distance L in the x direction between pixels backward and forward the object pixel that have image data, i.e., pixels where A(x, y)=1, is larger than the distance Lmax at which it is necessary to perform a preliminary ejection in connection with the first ejection characteristic. When the distance in the main scan direction between pixels backward and forward that pixel is not large enough to cause any degradation in the first ejection characteristic (L<Lmax) even if the object pixel is one that requires the preliminary ejection (B(x, y)=1), then the first ejection characteristic of the following image data-based ejection is not degraded. Therefore, in order not to perform the preliminary ejection at the object pixel, step S15 erases the preliminary ejection data B(x, y)=1 and sets C(x, y)=0. As a result, the ejection data will be D(x, y)=0. If, in detecting the distance L, there is no image data at pixels on the left side of (before) the object pixel in the x direction, the number of pixels including x=0 up to the object pixel is taken as the distance L.

In this embodiment the number of pixels that requires the preliminary ejection is assumed to be Lmax=8. Therefore, in step S6 if the number of pixels L having no image data in backward and forward of the object pixel has a relation of L<Lmax, step S15 sets C(x, y)=0 causing the ejection data to be D(x, y)=0. Step S6, as described above, is the step which checks the content of a pixel based on the image data in order to eliminate the pixel for which the preliminary ejection is not executed out of the pixels for which the preliminary ejection is to be executed.

On the other hand, if L≧Lmax, where L is the distance between two pixels in both of which the image data exists among backward and forward pixels of the object pixel, at the step S6, the processing moves to step S7. Step S7 checks if there is image data in predetermined four pixels adjoining the object pixel (x, y). The four pixels adjoining the object pixel are A(x−1, y−1), A(x, y−1), A(x+1, y−1) and A(x+1, y). If there is no image data in these four pixels, step S14 sets D(x, y)=1. That is, if the image data does not exist at the adjoining pixel which needs to execute the preliminary ejection, data processing is performed so that ink is ejected to the pixel which needs to execute the preliminary ejection.

At an object pixel (6, 10), for example, B(6, 10)=1. But at the four adjoining pixels of the pixel (6, 10), there is no image data, i.e., A(5, 9)=0, A(6, 9)=0, A(7, 9)=0 and A(7, 10)=0. Therefore, the preliminary ejection is performed at this object pixel (x, y)=(6, 10) and the final ejection data will be D(x, y)=1.

If there is image data in the predetermined four adjoining pixels, step S8 to step S12 detect data to be moved (also referred to as "move data").

Step S8 sets an adjoining image data candidate. Here, the candidate move data in one of the four adjoining pixels is assumed to be A(X, Y). That is, if the pixel of the candidate data is (x−1, y−1), then X=x−1 and Y=y−1 are set. In the next step S9, it is checked whether there is image data between A(X+1, Y) and A(Xmax, Y). If image data does not exist, the image data in the adjoining pixel A(X, Y) is moved to the object pixel (x, y). That is, C(X, Y)=0 is set at a pixel (X, Y) causing D(X, Y)=0 to be set (step S14) as the final ejection data at this adjoining pixel (step S13) and D(x, y)=1 to be set at the object pixel (step S14).

In step S9 if image data exists between A(X+1, Y) and A(Xmax, Y), the same decision as sep S6 is made. That is, a check is made to see if a distance L' between those pixels backward and forward, and including, the adjoining pixel (X, Y) that have image data is larger than the distance Lmax at which it is necessary to perform a preliminary ejection (step S10).

If the number of pixels L' having no image data backwards and forwards of the adjoining pixel has a relation of L'<Lmax, the image data of the adjoining pixel A(X, Y)=1 is moved to the object pixel (x, y). That is, setting is performed so that ink is not ejected to the adjoining pixel, and ink is ejected to the object pixel for which the preliminary ejection is to be performed. Specifically, C(X, Y)=D(X, Y)=0 (step S13) and D(x, y)=1 are set (step S14). This embodiment carries out "move of image data" by "eliminating of image data" and "logical addition of the image data and the preliminary ejection data".

For example, at an object pixel (8, 8), A(8, 8)=0 and B(8, 8)=1 and thus L>Lmax. So, the processing moves to step S7. Since image data exists at (8, 7) among the four adjoining pixels, the candidate move data is A(8, 7). Then step S9 checks if there is image data between A(X+1, Y) and A(Xmax, Y). The check finds that image data exists at (15, 7) between A(9, 7) and A(15, 7). Thus, the processing moves to step S10. Here, it is checked whether L'>Lmax. Since the distance between those pixels backwards and forwards, and including, the adjoining pixel (8, 7) that have image data is larger than the distance Lmax at which it is necessary to perform a preliminary ejection, another candidate is searched (step S11). Other adjoining pixels that may be used for possible candidate data have no image data. So, D(8, 8)=1 is set (step S14) and the processing proceeds to the next pixel. That is, if the image data exist at the vicinity pixel of the pixel which needs to execute the preliminary ejection, data processing is performed so that ink is not ejected at the vicinity pixel and ink is ejected at the pixel which needs to execute the preliminary ejection.

If L'≧Lmax, it is checked whether there is another data to be moved (step S11). If so, the processing proceeds to step S12 and a check is made beginning with step S9 as to whether or not to move the data. By moving the image data of the adjoining pixel as the preliminary ejection data, localized changes in density that would result when the preliminary ejection data is printed close to the image data are alleviated.

Meanwhile, at step S11, if data does not exist, the preliminary ejection data B(x, y)=1 is reflected as is and D(x, y)=1 is set.

For example, at (x, y)=(11, 9), A(11, 9)=0 and B(11, 9)=1. Predetermined four adjoining pixels are A(10, 8)=0, A(11, 8)=0, A(12, 8)=1 and A(12, 9)=1. Here, although A(12, 8)=1 and A(12, 9)=1, the image data of (12, 8) that was searched first is given priority in the selection of the data to be moved. The image data of (12, 8) is moved to (11, 9) and D(12, 8)=0 (step S13) and D(11, 9)=1 (step S14) are set.

When there is a plurality of image data in the predetermined four adjoining pixels, the above selection of move data is not limited to a particular means. For example, the move data may be determined according to the amount of surrounding pixels or another data determination method may be employed.

The above process from step S3 to step S15 is performed for all pixels in the x direction (step S16) until there is no unprocessed pixel in the x direction (step S17), at which time the processing proceeds one pixel in the y direction (step S18). When all pixels in the y direction are processed (step S19), the process of adding preliminary ejection data is completed.

Note that, in FIG. 6, image data of the vicinity pixel is moved to the position for the preliminary ejection in order to eject ink to the position of the preliminary ejection and not to eject ink to the vicinity of the preliminary ejection position. However, in this embodiment, it can be achieved that ink is ejected to the position for the preliminary ejection and is not ejected to the vicinity of the preliminary ejection not by moving image data of the vicinity pixel position, but by only eliminating the image data, because the preliminary ejection data is preliminarily provided. Thus, such configuration is included in this embodiment. In this case, instead of "moving of image data", "eliminating of the image data of the vicinity pixel" and "the logical addition of the image data" are performed.

The ejection data generated as described above is sent to the print buffer 229.

Figure 7:
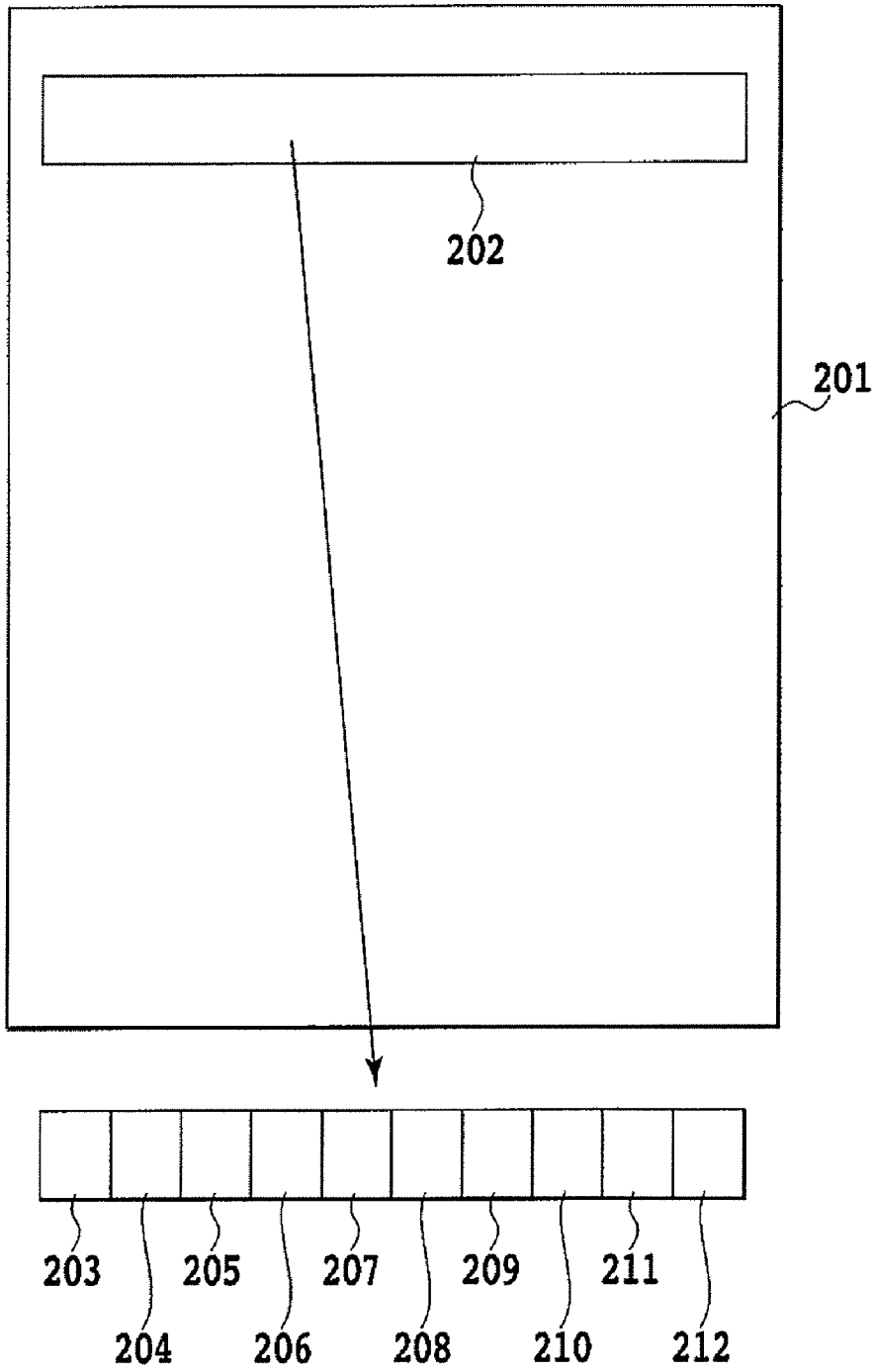
FIG. 7 is a block diagram showing details of a print buffer according to embodiment 1 of this invention.

FIG. 7 is a block diagram showing details of the print buffer. As described above, the print buffer has a capacity of one scan of print head. The capacity 202 of the print buffer is divided into 10 blocks 203 to 212. When a predetermined volume of data is accumulated in the internal capacity of the print buffer, the MPU 221 starts the print medium feeding operation by the transport drive system 224 through the ASIC 222. Then, the carriage drive system 223 moves the carriage and the recovery drive system 225 performs a recovery operation before printing, as required. The MPU 221 also makes image output position settings with the ASIC 222 and starts the printing operation. When the carriage moves to the print start position, the print data stored in the print buffer is sequentially read out in synchronism with the ejection timing and the ejection data transferred to the print head for printing.

With the above series of operations repeated, image is successively formed on the print medium.

As explained above, if the image data exists in the vicinity pixel to a pixel for which an image data does not exist, and a preliminary ejection is to be excused, an ink ejection is not performed to the vicinity pixel. For example, it eliminates the image data in the vicinity pixel. While, to the pixel for which the preliminary ejection is to be executed, the ink ejection is performed independently of the fact whether image data exist or not in the vicinity pixel. As a result, the overlapping of the preliminary ejection dot and the image dot of vicinity can be reduced while executing necessary preliminary ejection, thus changing density which is caused by mixing these dots can be reduced.

It should be noted that this embodiment is not limited to an aspect that performs all procedures (from step S1 to step S19) shown in FIG. 6, and may skip a part of the procedures. For example, this embodiment is featured in that the image data at the vicinity pixel is eliminated (moved) if the image data exists at the vicinity of the position of the preliminary ejection at which the pixel data does not exist, as described above. Thus, the procedure which is not relevant to these features, such as steps S5, S6 and S15, may be skipped. However, if step S5 and S6 are skipped, the pixel for which the preliminary ejection will be performed becomes the pixel for which the preliminary ejection is to be performed, and then the dots of the preliminary ejection increase. On the other hand, if steps S5 and S6 are not skipped, the pixel other than the pixel which is evaluated as not necessary to perform the preliminary ejection based on the image data, out of the pixels for which the preliminary ejection will be performed, becomes the pixel for which the preliminary ejection is to be performed, and then the dots of the preliminary ejection decrease.

In addition, this embodiment can replace a part of procedures (from step S1 to step S19) shown in FIG. 6 by another procedure. For example, although selecting the image data candidate, which will be eliminated (moved) out of the vicinity pixels for the preliminary ejection, that embodiment is not limited to this embodiment. In selecting the image data candidate which will be eliminated (moved), the image data may be selected from the pixels (vicinity pixels) which exist at a position having a distance of a few pixels from the position for the preliminary ejection, and are not adjoining positions of the preliminary ejection.

Embodiment 2

In embodiment 1 ejection data is generated by storing preliminary ejection data in a ROM beforehand, comparing the binary preliminary ejection data with image data and preliminary ejection data read of ROM. However, the ejection data is generated by not having preliminary ejection data beforehand but referencing image data as the preliminary ejection data is added in this embodiment. In addition, as in embodiment 1, if the image data exists in the vicinity pixel for which the image data exist, it performs the data processing for not ejecting ink at the vicinity pixel, an ink ejection is not performed to the vicinity pixel, in this embodiment 2.

Figure 8:
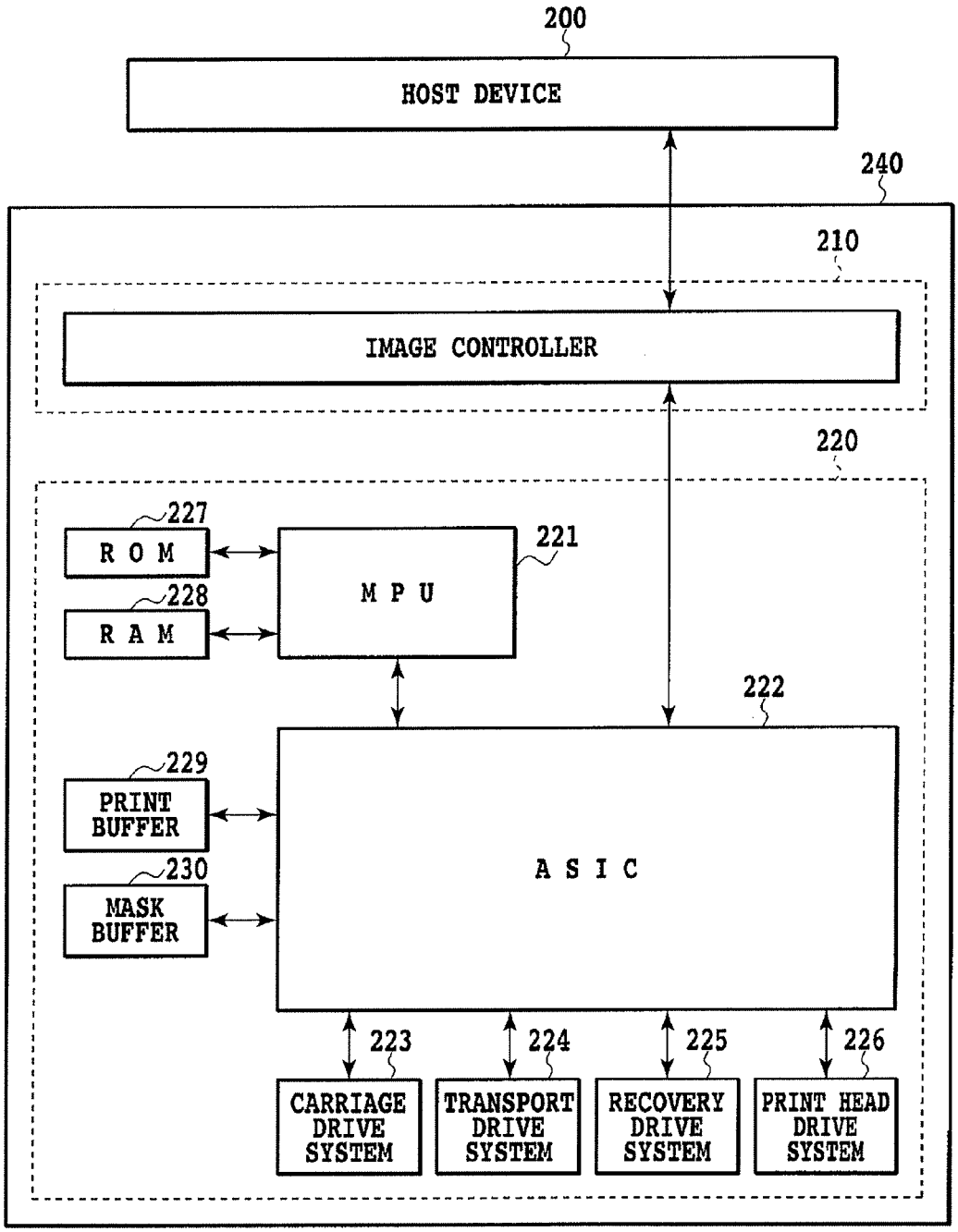
FIG. 8 is a block diagram showing a control configuration to execute image processing according to embodiment 2 of this invention.

FIG. 8 is a block diagram showing a control configuration for image processing in the second embodiment. This control configuration is similar to that of embodiment 1 shown in FIG. 2 except that the control configuration of embodiment 2 does not have the ROMβ that stores on-paper preliminary ejection data beforehand.

Now, the method of adding preliminary ejection data according to the second embodiment of this invention will be explained.

As in embodiment 1, a 16×16 pixel array is taken as an example for the sake of simplicity of drawing and explanation.

Figure 9A:
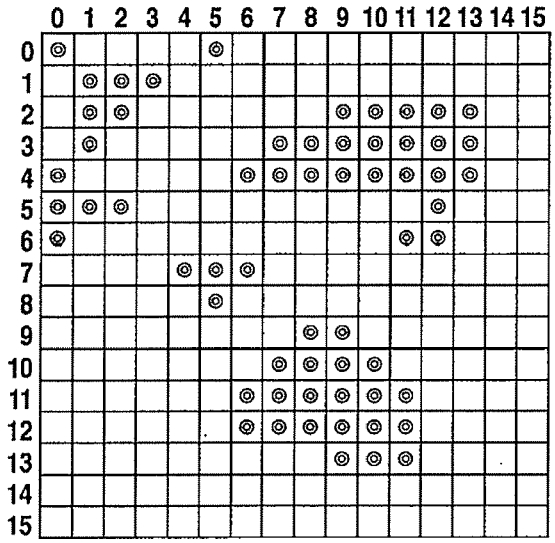
FIGS. 9A, 9B and 9C show examples of data positions in pixels.
Figure 9B:
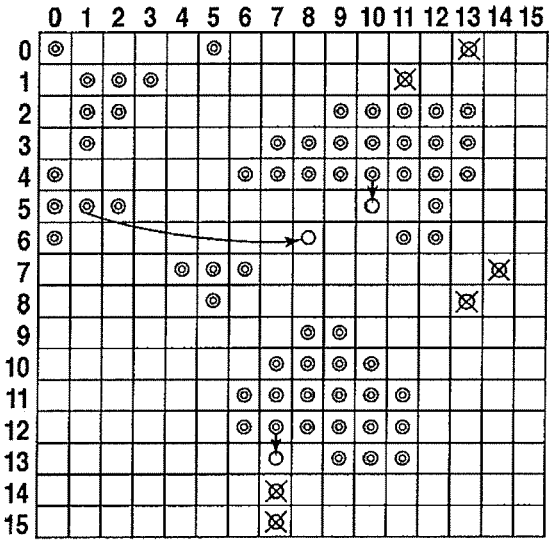
Figure 9C:
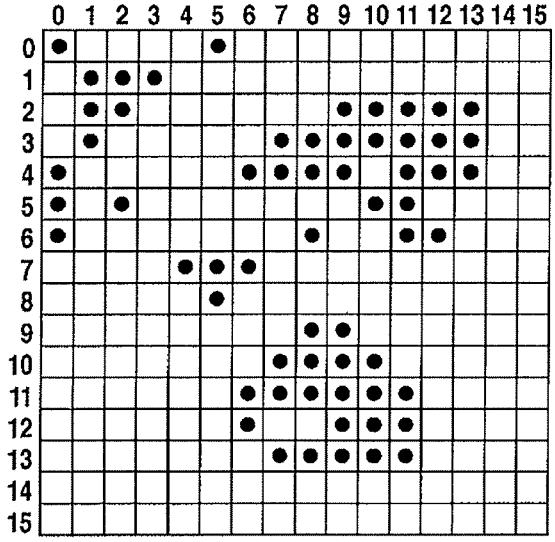

FIGS. 9A to 9C show the process of adding to image data in the 16×16 pixel array preliminary ejection data for one of C, M, Y and K print heads. Of these figures FIG. 9A represents image data. Here the marking "◉" indicates that the image data is "1" for ejection, meaning that a dot will be formed at that pixel. FIG. 9B shows data array added performed on the preliminary ejection data and data processing of FIG. 10 on the image data of FIG. 9A. FIG. 9C shows ejection data that has been subjected to the data processing of FIG. 10 and which causes ink to be actually ejected from the print head.

Figure 10:
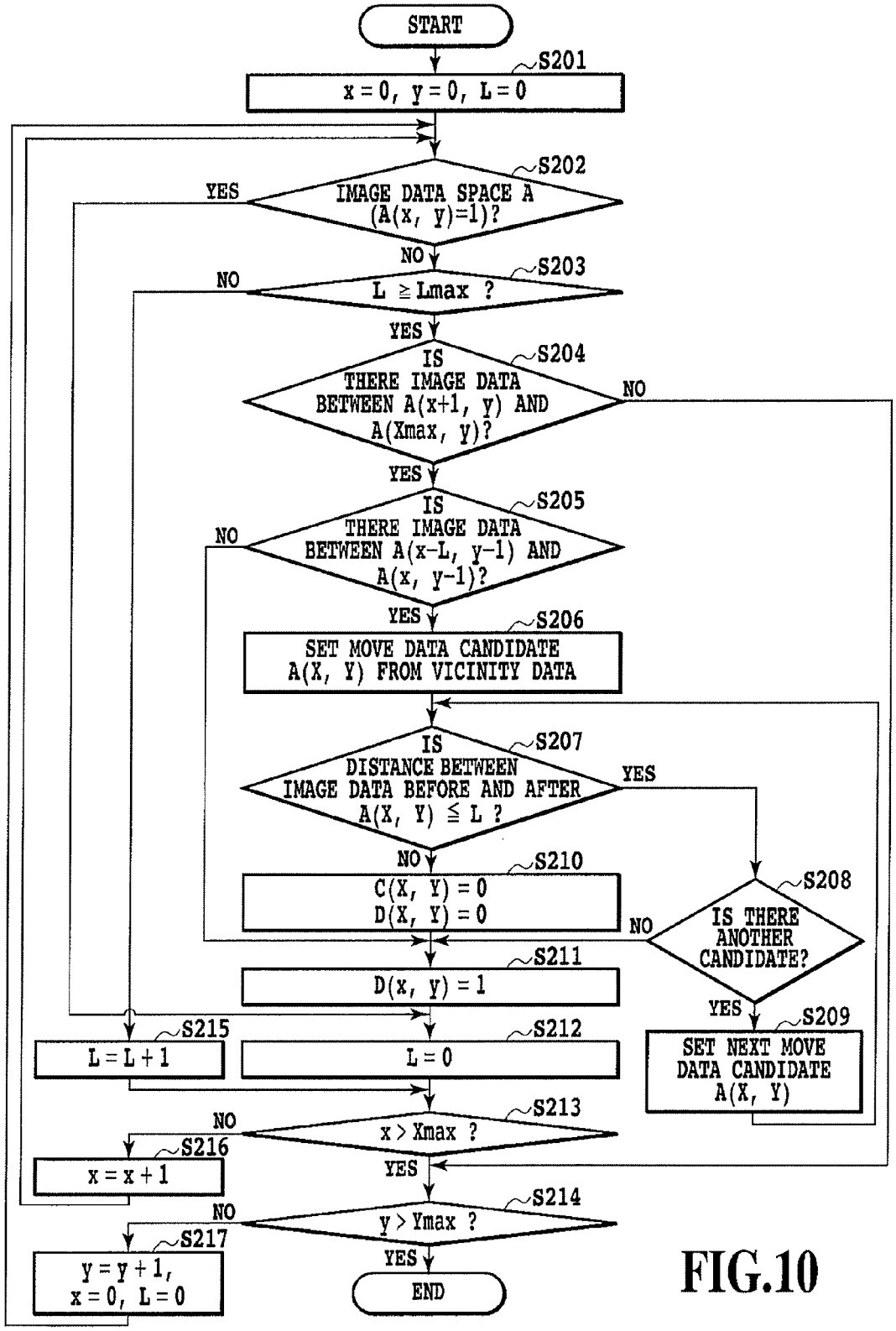
FIG. 10 is a flow chart showing a process of adding preliminary ejection data according to embodiment 2 of this invention.

FIG. 10 is a flow chart showing the process of adding preliminary ejection data according to this embodiment.

In the following explanation, as in embodiment 1, it is assumed that a main scan direction of the print head is x and a sub scan direction (nozzle array direction in the print head) is y and that the image data of one scan shown in FIG. 9, when viewed in the x direction, ranges from 0 to Xmax (in FIG. 9, from 0 to 15) and, when viewed in the y direction, ranges from 0 to Ymax (in FIG. 9, from 0 to 15). In the image data shown in FIG. 9A, image data at a pixel location (x, y) is denoted A(x,y), and data shown in FIG. 9B is denoted C(x, y) and ejection data shown in FIG. 9C is denoted D(x, y).

The processing shown in FIG. 10 involves checking the addition of the preliminary ejection data to each pixel location beginning with x=0 toward x=Xmax in the x direction one pixel at a time and then executing this x-row direction processing from y=0 toward y=Ymax sequentially one x row at a time until the addition of the preliminary ejection data is determined for the entire one-scan data.

First, at step S201, y=0, x=0 and L=0 are set. That is, first object pixel of the image to be processed is determined.

Next, a check is made as to whether at the object pixel position there is image data (marking "="1"). If image data exists, D(x, y)=1 is set and step S212 sets L1=0 before proceeding to the pixel processing of the next coordinate. If image data does not exist at the object pixel, it is checked whether L≧Lmax (step S203)

In this embodiment, the distance which the image data exist in the present pixels backwards and forwards is L, and the number of pixels at which the preliminary ejection needs to be executed is assumed to be Lmax=8. If at step S203 L≧Lmax, the processing moves to step S204. If the interval is such as will not cause degradations in a first ejection characteristic, i.e., L<Lmax, step S215 sets L=L+1 and proceeds to the pixel processing of the next coordinate.

Step S204 checks if there is image data between the object pixel and Xmax to the right. If there is the image data, the processing proceeds to step S205, because it is necessary to perform the preliminary ejection at the present pixel. On the other hand, if there is no image data, since it is not necessary to perform the preliminary ejection at the pixel line, it is determined whether other object line exists or not (step S214). If it is determined that other object line exists, the processing moves to the next pixel line as present line (step S217). At an object pixel (11, 1) for example, L=Lmax=8 and there is no image data in pixels arrayed in the main scan direction from (12, 1) to (Xmax, 1). So, D(11, 1)=0 (step S211), and the present line moves next line through step 217.

Step S205 checks whether image data exists in predetermined pixels of the vicinity object pixel. The object pixel of processing is the pixel for which it is necessary to perform the preliminary ejection, as described above at step S205. Thus, step S205 determines whether the image data exists or not at vicinity pixel at which image data does not exist. In addition, the predetermined pixels of the vicinity object pixel ranges from (x−L, y−1) to (x, y−1). If there is no image data in these pixels, it is not possible to move data from the vicinity pixel, step S211 sets D(x, y)=1 and this present pixel is added to preliminary ejection. If image data exists in the pixels from (x−L, y−1) to (x, y−1), step S206 to step 209 search data to be moved.

Step S206 sets an image data candidate out of the vicinity data above. The candidate data to be moved is assumed to be A(X, Y). The next step S207 checks whether a distance between those pixels backwards and forwards, and including, the image data A(X, Y) of the vicinity pixel that have image data is larger than the distance L at which it is necessary to perform a preliminary ejection. If the pixel distance is less than L, the image data A(X, Y) of the vicinity pixel is moved to the object pixel (x, y). That is, C(X, Y)=D(X, Y)=0 (step S210) and D(x, y)=1 (step S211) are set. As above, it is possible to perform the preliminary ejection at the present pixel by moving the image data of the vicinity pixel to the object pixel. Then step S212 sets L=0 before proceeding to the pixel processing of the next coordinate.

If the pixel distance is greater than L at step S207, a check is made to see if there is another candidate data to be moved (step S208). If so, the processing proceeds to step S209 and next candidate data for moving is processed same processing. It is possible to perform the preliminary ejection at the present pixel by moving the image data of vicinity pixel to the position for which the preliminary ejection is not executed at step 207 to S209 as above. This "moving of the image data" is carried out by "eliminating the image data" and "addition of the preliminary ejection data".

At (x, y)=(10, 5), for example, A(10, 5)=0 and L=8. And at predetermined pixels of the vicinity object pixel that range from (x, y)=(2, 4) to (10, 4), data are A(6, 4)=A(7, 4)=A(8, 4)=A(9, 4)=A(10, 4)=1. Image data at pixel (10, 4) with its x value closest to the x value of the object pixel is given priority in determining the move candidate data. Since the distance between those pixels backwards and forwards, and including, the pixel (10, 4) which have image data is zero, the candidate moved image data of pixel A(10, 4) is moved to a pixel (10, 5). D(10, 4)=0 is set (step S210), and image data D(10, 5)=1 moved from D(10, 4) is set(step S211).

When there are a plurality of print data in the predetermined vicinity pixels, the selection of move data is not limited to a particular means.

The above process from step S210 to step S212 is performed for all pixels in the x direction (step S216) until there is no unprocessed pixel in the x direction (step S213), at which time the processing proceeds one pixel in the y direction (step S217). When all pixels in the y direction are processed (step S214), the process of adding preliminary ejection data is completed.

As explained above, if the image data exists in the vicinity pixel to a pixel for which an image data does not exist, and a preliminary ejection is to be excused, an ink ejection is not performed to the vicinity pixel. While, to the pixel for which the preliminary ejection is to be executed, the ink ejection is performed independently of the fact whether image data exist or not in the vicinity pixel. As a result, the overlapping of the preliminary ejection dot and the image dot of vicinity can be reduced while executing necessary preliminary ejection, thus changing density which is caused by mixing these dots can be reduced.

Embodiment 3

In embodiment 1 and embodiment 2, the print buffer 229 has a memory capacity of one scan. The print buffer 229 may have less than the capacity of one scan, for example one-half the capacity of one scan.

Figure 11:
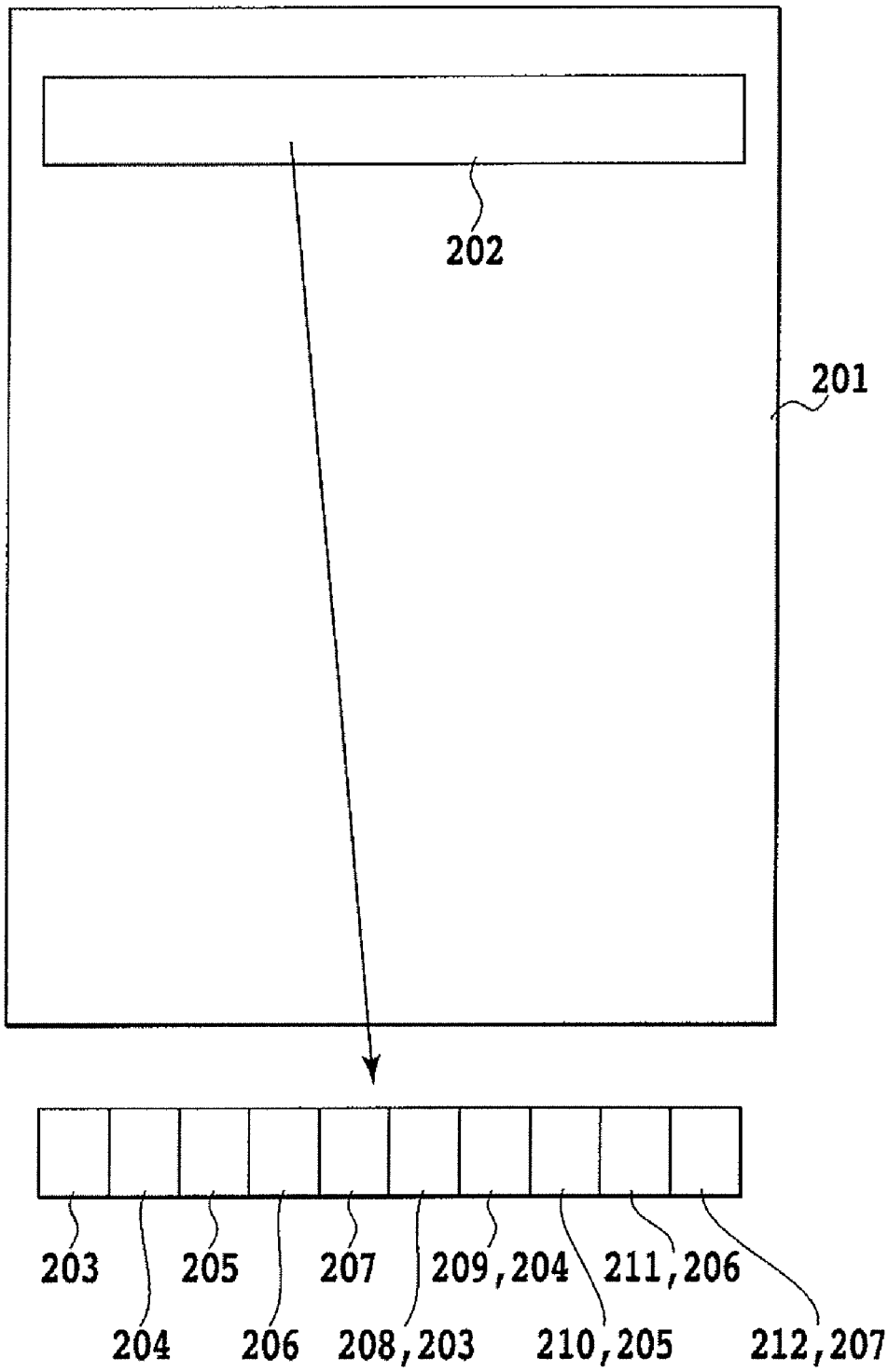
FIG. 11 is a block diagram showing details of a print buffer according to embodiment 2 of this invention.

FIG. 11 is a block diagram showing details of the print buffer of this embodiment. As shown in the figure, the capacity 202 of the print buffer is divided into five blocks 203 to 207. When a predetermined volume of data is accumulated in the internal capacity of the print buffer, the MPU 221 starts the print medium feeding operation by the transport drive system 224 through the ASIC 222. Each time the data is read out, the next block of data is saved, using the memory in a toggle-like fashion. The image controller has a memory capacity of less than one scan, so the data of one scan is divided and the divided blocks of data are sequentially processed.

Since at the start of one scan this embodiment cannot reference image data up to the end of one scan, only a limited number of blocks of image data is referenced and attached with preliminary ejection data to create print data.

Now, the method of adding preliminary ejection data according to this embodiment will be explained. As in embodiment 1 and embodiment 2, if the image data exists in the vicinity pixel of the position of preliminary ejection at which the image data dose not exist, the image data in vicinity pixel is moved to the position of the preliminary ejection.

As in embodiment 1 and embodiment 2, a 16×16 pixel array is taken as an example for the sake of simplicity of drawing and explanation.

Figure 12A:
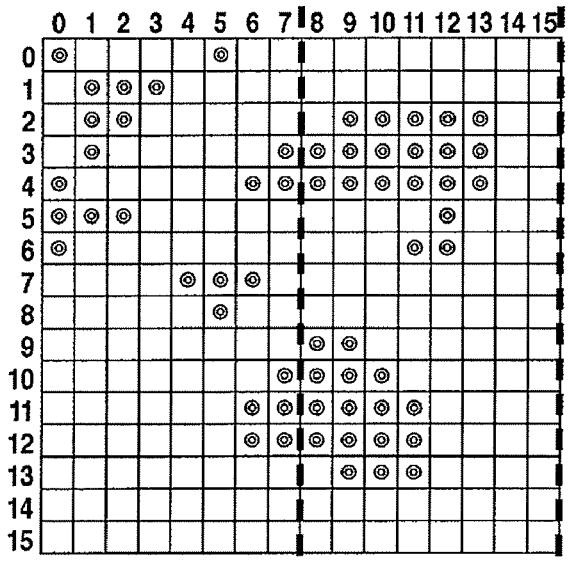
FIGS. 12A, 12B and 12C illustrate examples of data positions in pixels.
Figure 12B:
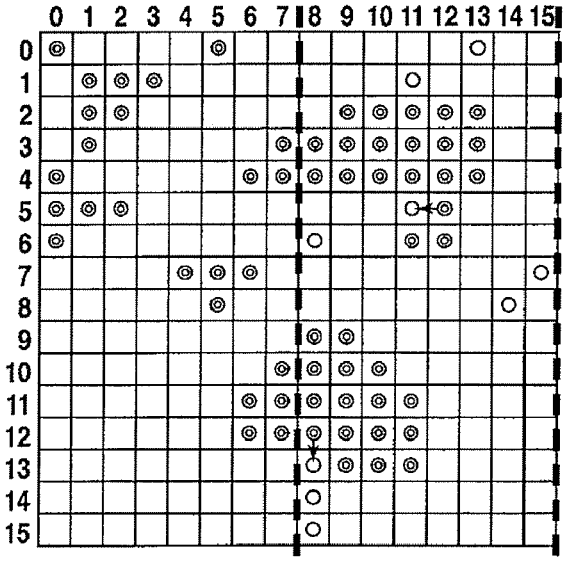
Figure 12C:
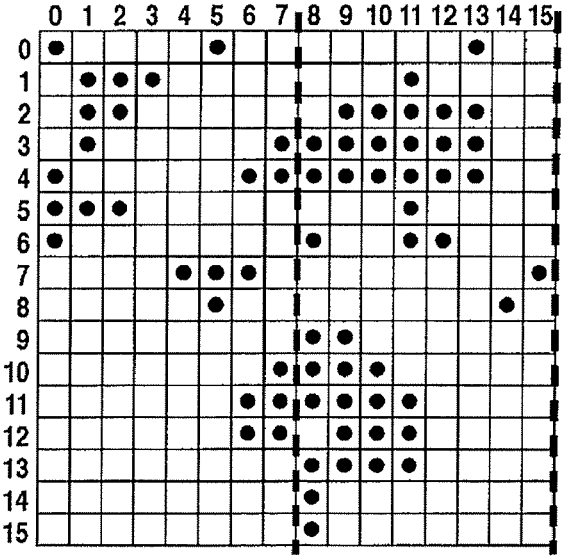

FIGS. 12A to 12C show the process of adding to image data in the 16×16 pixel array preliminary ejection data for one of C, M, Y and K print heads. Of these figures FIG. 12A represents image data. Here the marking "◉" indicates that the image data is "1" for ejection, meaning that a dot will be formed at that pixel. FIG. 12B shows data array added, performed on the preliminary ejection data processing of FIG. 13 on the image data of FIG. 12A. FIG. 12C shows print data that has been subjected to the data processing of FIG. 13 and which causes ink to be actually ejected from the print head.

Figure 13:
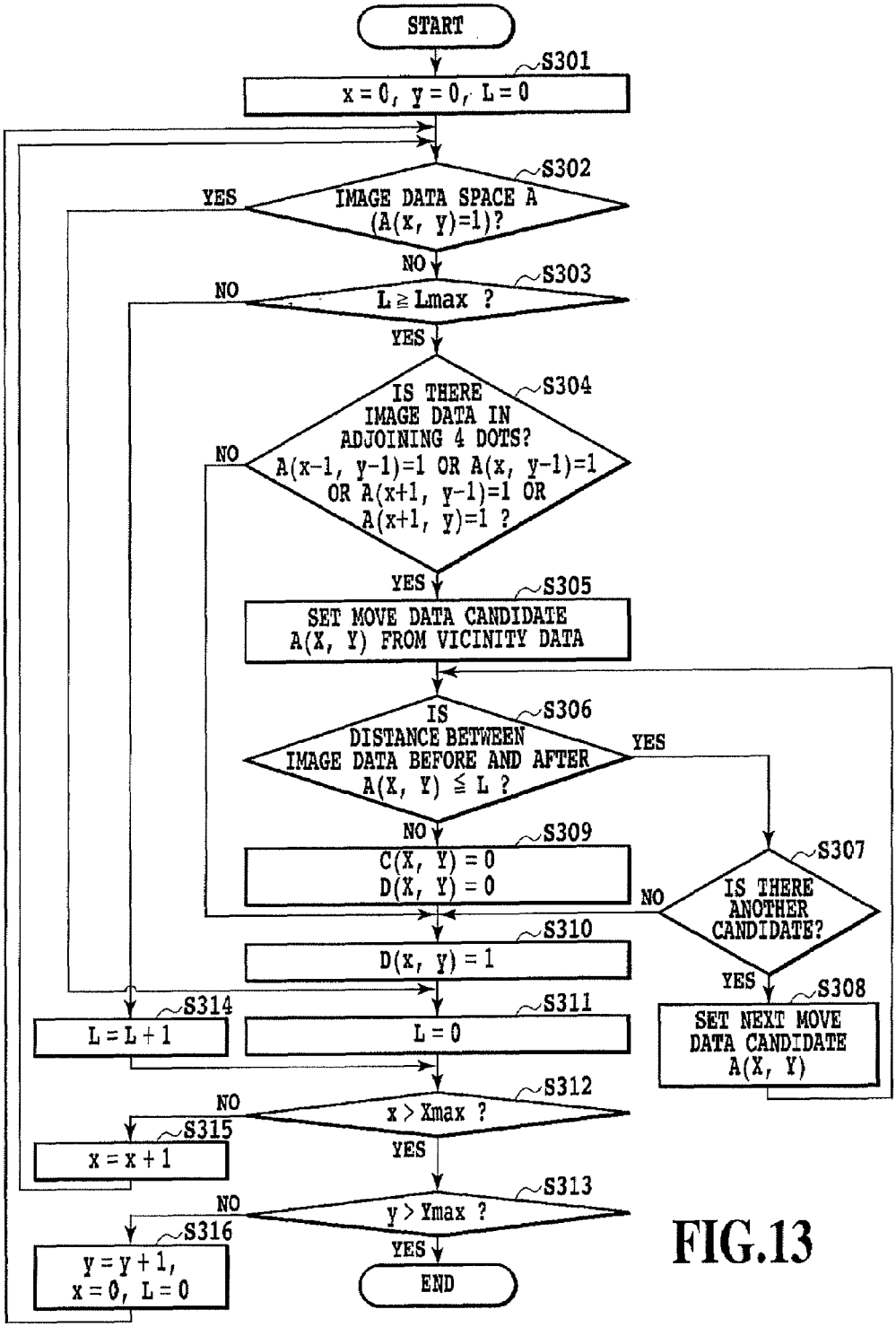
FIG. 13 is a flow chart showing a process of adding preliminary ejection data according to embodiment 3 of this invention.

FIG. 13 is a flow chart showing the process of adding preliminary ejection data according to this embodiment.

In the following explanation, as in embodiment 1 and embodiment 2, it is assumed that a main scan direction of the print head is x and a sub scan direction (nozzle array direction in the print head) is y and that the image data of one scan shown in FIG. 12, when viewed in the x direction, ranges from 0 to Xmax (in FIG. 12, from 0 to 15) and, when viewed in the y direction, ranges from 0 to Ymax (in FIG. 12, from 0 to 15). In the image data shown in FIG. 12A, image data at a pixel location (x, y) is denoted A(x,y), and data shown in FIG. 12B is denoted C(x, y) and ejection data shown in FIG. 12C is denoted D(x, y).

The processing shown in FIG. 13 involves checking the addition of the preliminary ejection data to each pixel location beginning with x=0 toward x=Xmax in the x direction one pixel at a time and then executing this x-row direction processing from y=0 toward y=Ymax sequentially one x row at a time until the addition of the preliminary ejection data is determined for the entire one-scan data.

This embodiment performs processing almost similar to that of embodiment 2, except that this embodiment does not execute step S205. That is, in the main scan direction of the print head, even if there is no image data following the object pixel, a candidate of move data is searched (step S304), rather than setting C(x, y)=D(x, y)=0.

Then, a check is made to see if there is image data in predetermined four pixels adjoining the object pixel (step S304) and the image data that can be moved is moved (step S305 to S310). In this case, predetermined four pixels means as the four pixels describe in the first embodiment.

Figure 14:
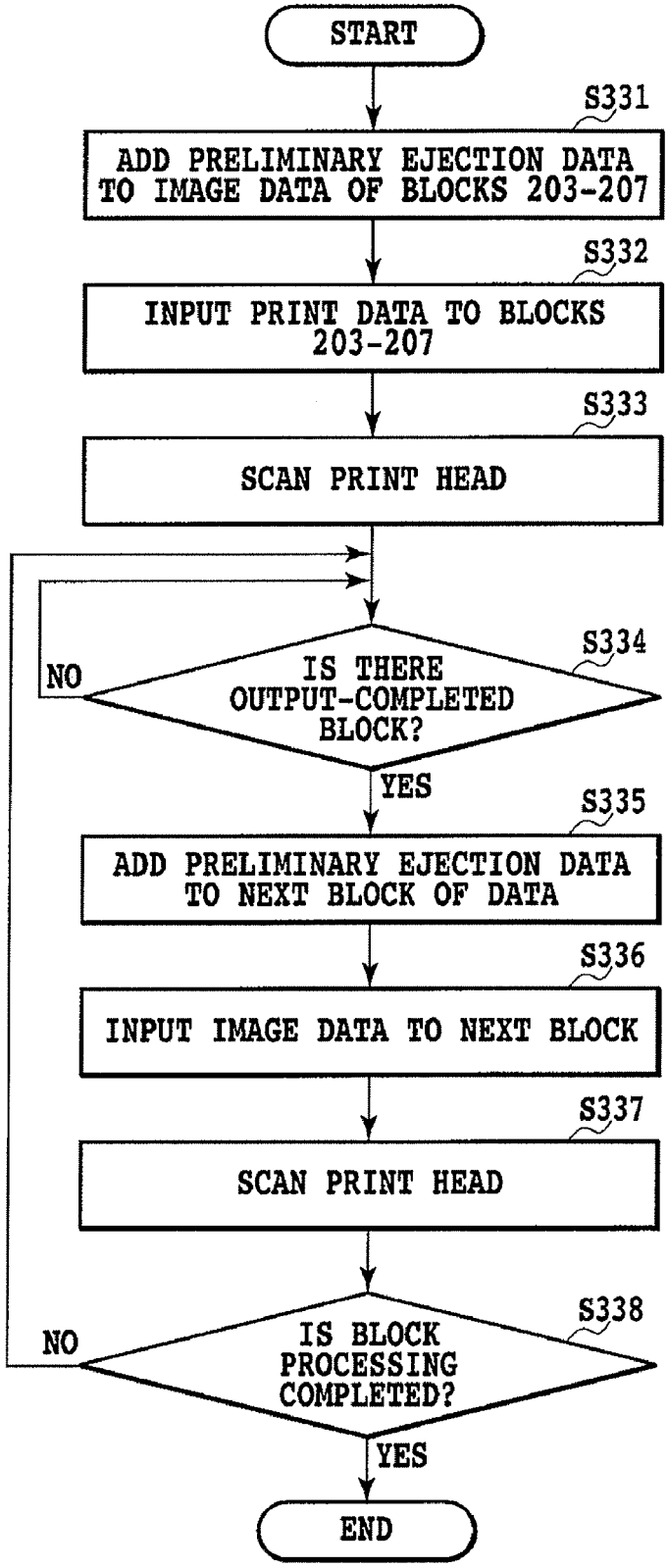
FIG. 14 is a flow chart showing a sequence of one scan performed by a print head according to embodiment 3 of this invention.

FIG. 14 is a flow chart showing a sequence of steps performed in the processing of one scan of print head. Preliminary ejection data is added to blocks of image data 203 to 207 to create print data (ejection data), which is then input to the print buffer whose capacity is divided. The data thus obtained is sent to the print head to scan the print head. As one block of data is output, the next block of data is processed. When all blocks are processed, the processing of one scan of print head is complete.

With the above configuration, this invention can be applied even when the memory capacity of the print buffer 229 is small. Therefore, whatever the memory capacity, image quality degradations can be minimized by moving image data of a pixel situated close to where an on-paper preliminary ejection is required.

Other Embodiments

In the above embodiment 1 through 3, we have explained about examples of the on-paper preliminary ejection based on the so-called first ejection characteristic. Each of the above embodiments therefore performs the normal preliminary ejection for preventing ejection failures in addition to the on-paper preliminary ejection of this invention that has been described to be performed every scan. It is noted that the application of this invention is not limited to these embodiments. In place of, or in combination with, the normal preliminary ejections performed outside a print medium immediately before the printing or during the printing periodically, the on-paper preliminary ejection may be executed for the purpose of preventing general ejection failures.

Such a case can be realized basically by omitting steps S5, S9 from the processing of FIG. 6. Further, in this case, the parameters L, L' used in the decisions of steps S6 and S10 can be determined by also taking into consideration the pixel rows to be printed in the next or the following main scans.

Even in a configuration that does not perform the preliminary ejection outside the print medium, this invention makes it possible to minimize image quality degradations by moving image data of a pixel situated close to where the on-paper preliminary ejection is required.

In the above embodiments 1 through 3, an explanation is made about the data processing for performing the preliminary ejection in the print apparatus. However, the application of the present invention is not limited to these embodiments. For example, the above-described data processing can be performed in a host device connected with the print apparatus. In this case, the data processing is performed by a printer driver installed on the host device and a CPU of the host device. The apparatus of data processing for performing the preliminary ejection may be the print apparatus or the host device as described above.

In the above embodiments 1 through 3, the explanation is made about serial type printer that performed printing while moving (scanning) a print head relative to print medium. The application of the present invention is not limited to this serial type printer. The present invention may be applicable to, line type printer that performs printing while moving (conveying) a print medium relative to a line head where length spans over all width of the print medium width. In this manner, the invention may be applicable to printers which perform printing while causing the print head to move relative by the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-362418,filed Dec. 15, 2005, which is hereby incorporated by reference herein in its entirety.

What is claimed is:

1. A data processing apparatus for processing image data for ejecting ink from a print head onto a print medium, the data processing apparatus comprising:

a determining unit that determines whether a first pixel, to which an ink ejection based on the image data is to be performed, exists or not in a vicinity of a second pixel to which an ink ejection based on the image data is not to be performed and to which a preliminary ejection of ink by the print head is to be performed; and a data processing unit that processes the image data so that ink is not ejected to the first pixel, if said determining unit determines that the first pixel exists.

2. A data processing apparatus according to claim 1, wherein if said determining unit determines that the first pixel exists, said data processing unit processes the image data so that the image data in the first pixel is deleted.

3. A data processing apparatus according to claim 1, further comprising a memory storing a preliminary ejection data which sets predetermined pixels to which the preliminary ejection should be performed, wherein the pixels to which the preliminary ejection is to be performed is determined according to the preliminary ejection data.

4. A data processing apparatus according to claim 3, wherein, among the predetermined pixels to which the preliminary ejection should be performed, the pixels to which the preliminary ejection is to be performed are those that are not subject to ink ejection based on the image data.

5. A data processing apparatus according to claim 1, wherein the pixels to which the preliminary ejection is to be performed are determined according to image data.

6. An inkjet printing apparatus capable of ejecting ink from a print head onto a print medium based on image data and preliminary ejection data, comprising:

a determining unit that determines whether a first pixel, to which an ink ejection based on the image data is to be performed, exists or not in the vicinity of a second pixel, to which an ink ejection based on the image data is not to be performed and to which an ink ejection based on the preliminary ejection data is to be performed; and a controller that causes the print head not to eject ink to the first pixel, if said determining unit determines that the first pixel exists.

7. A controlling method of controlling an inkjet printing apparatus capable of ejecting ink from a print head onto a print medium based on image data and preliminary ejection data, comprising:

a determining step of determining whether a first pixel, to which an ink ejection based on the image data is to be performed, exists or not in the vicinity of a second pixel, to which an ink ejection based on the image data is not to be performed and to which an ink ejection based on the preliminary ejection data is to be performed; and a controlling step of causing the print head not to eject ink to the first pixel, if determined in said determining step that the first pixel exists.

* * * * *